US006669175B2

(12) United States Patent
Snow et al.

(10) Patent No.: US 6,669,175 B2
(45) Date of Patent: Dec. 30, 2003

(54) TILE TYPE FENCING INSERT

(76) Inventors: Jeffrey M. Snow, 3519 Westminster Way, Bloomington, IN (US) 47401; Michael G. Snow, 3519 Westminster Way, Bloomington, IN (US) 47401

( * ) Notice: Subject to any disclaimer, the term of this patent is extended or adjusted under 35 U.S.C. 154(b) by 0 days.

(21) Appl. No.: 10/117,410

(22) Filed: Apr. 5, 2002

(65) Prior Publication Data

US 2003/0189199 A1 Oct. 9, 2003

(51) Int. Cl.[7] ..... F16B 1/00
(52) U.S. Cl. ..... 256/32; 256/47; 256/1
(58) Field of Search ..... 256/32, 33, 34, 256/45, 47, 50, 1

(56) References Cited

U.S. PATENT DOCUMENTS

| | | | | |
|---|---|---|---|---|
| 416,826 A | | 12/1889 | Cooper | |
| 507,952 A | | 10/1893 | White | |
| 1,058,274 A | | 4/1913 | Tirapani | |
| 1,064,897 A | | 6/1913 | Gabet | |
| 1,575,409 A | | 3/1926 | Blaeser | |
| 2,760,759 A | | 8/1956 | Rice | |
| 2,954,964 A | | 8/1960 | O'Haffey | |
| 3,774,884 A | | 11/1973 | Singer | |
| 3,964,197 A | | 6/1976 | Tucker et al. | |
| 4,582,284 A | * | 4/1986 | Veenstra | 256/32 X |
| 4,651,975 A | | 3/1987 | Howell | |
| 5,177,890 A | | 1/1993 | Hisatomi | |
| 5,255,898 A | * | 10/1993 | Cacicedo | 256/47 |
| 5,342,021 A | | 8/1994 | Watson | |
| 5,775,676 A | | 7/1998 | Hoggan | |

* cited by examiner

*Primary Examiner*—John R. Cottingham
(74) *Attorney, Agent, or Firm*—Law Offices of Royal W. Craig

(57) ABSTRACT

A rectangular sheet of flexible and resilient material such as plastic with notches at the midpoint of its sides. The size of the sheet and notches allow the insert to be placed into and located by a cell of a chain link fence. Notches fit around the wire crossovers of the chain link fence and locate the insert at the mid-plane of the fence. The corners of the insert extend into adjoining cells. Adjoining inserts overlap to provide complete visual privacy. The tile-like nature of the inserts allows great flexibility in arrangements and colors to provide visual privacy, decoration, words, logos, or signage.

12 Claims, 11 Drawing Sheets

TILE TYPE FENCING INSERT

CROSS-REFERENCE TO RELATED APPLICATIONS

Not Applicable.

BACKGROUND—FIELD OF THE INVENTION

This invention relates to inserts for chain link fences to provide privacy, decoration, or signage, particularity to a tile type insert that covers a fence cell and portions of the adjoining fence cells.

BACKGROUND—DESCRIPTION OF PRIOR ART

Chain link fences are formed from flattened helixes of wire that are interwoven to provide a laterally-projecting fence fabric with diamond shaped meshes or cells. The fence fabric is stretched and supported across posts to provide a fence. Chain link fences are very common due to their low cost and robust nature. However, the visually open mesh fabric provides little privacy or surface to decorate. There are multiple patents related to adding devices to the fence to improve privacy, decorate, or place signage.

The diamond shaped mesh of a chain link fences allows slats to be inserted or woven into the fence in a vertical, horizontal, or diagonal direction. U.S. Pat. No. 1,058,274 to Tirapani shows slats installed in the same type of mesh fabric used in chain link fences. U.S. Pat. No. 2,760,759 to Rice shows vertical and diagonal slats and mentions horizontal slats in fences to improve appearance and privacy. With both patents there are visual gaps and limited design flexibility to decorate or generate signage. U.S. Pat. No. 5,775,676 to Hoggan is an example of a method to improve the visual privacy of slats, fins are added to a slat. The patent also lacks design flexibility to decorate or generate signage. U.S. Pat. No. 2,954,964 to O'Haffey shows a diagonal slat with notches to fit around and be secured by the wire crossovers or knuckles of the fence. Again the diagonal and strip-like nature of these fence inserts limits the design flexibility to decorate or generate signage.

There are multiple patents to add tile type elements or inserts to a wire mesh or grid to provide great flexibility in changing color and distribution of inserts. This allows words, signage, logos, or decorations to be formed. Tile type element or insert here means an insert with the greatest horizontal dimension of the same magnitude as the greatest vertical dimension and multiple tile type elements can form an image. While not intend to form signage U.S. Pat. No. 416,826 to Cooper has a wire fabric with attachments or inserts to cover a building side. The attachments have only one point of attachment to the fence and thus are not secured well against wind. U.S. Pat. 507,952 to White uses spheres or marbles insert into a flexible wire mesh to form signage. The wire mesh must be a different design than a chain link and only sphere type shaped inserts may be used. U.S. Pat. No. 1,064,897 to Gabet has a wire mesh with snap in insert to form signage. The inserts use the straight portions of the fence wire to locate on and secure to not the wire cross-over area. The inserts are of complex three-dimensional shapes, therefore the inserts are not cheap and do not have a compact shape for ease of shipping. U.S. Pat. No. 1,575,409 to Blaeser provides a nameplate insert that occupies several cells of a fence. These inserts are partially held in place by the wire cross-over area but also use a staple or fastener secure the name plate insert. These inserts are not suitable for forming an image due to their irregular shape.

U.S. Pat. No. 3,774,884 to Singer shows a tile type insert to cover one cell. The insert is square in shape with tabs that are bend over the straight section of fence wire. The insert is time consuming to install or remove, three tabs must be bent or unbent. The insert aligns with the fence wire thus presenting a tilted square or diamond shape. U.S. Pat. No. 3,964,197 to Tucker et al shows a square insert with three tongues on each of two opposite sides of the insert. The middle tongue is pre-bent downward. The insert is also pre-bent around an axis that is at right angles to the insert side with tongues. The insert is temporarily bent by hand, the tongues are fit around straights sections of fence wire, then the insert is allowed to expand securing the insert to the fence wire. Tongues of adjoining inserts can interfere with each other requiring a variation of the normal insertion method. Pre-bending increases the insert's manufacturing cost. The insert generally aligns with the fence wire thus presenting a tilted square or diamond shape. There is no method to accurately control the side-to-side position or twist of the insert causing an irregular appearance unless care and adjustments are taken. Visual blockage is not complete.

U.S. Pat. No. 4,651,975 to Howell shows solid block inserts with a groove that fits around a straight section of fence wire. The blocks are secured to the fence wire by a cross wire that also extends to adjoining block to prevent rotation. The required cross wire makes installation and removal of the block time consuming. The insert aligns with the fence wire thus presenting a tilted square or diamond shape. Visual blockage is not complete. U.S. Pat. No. 5,177,890 to Hisatomi et al shows insert flaps of square material that hang on horizontal wires of a wire mesh. These inserts will only work with the horizontal wire of a wire mesh or wire fence. A chain link mesh does not have horizontal wires. U.S. Pat. No. 5,342,021 to Watson shows a round insert that clamps around the wire cross-over area of a chain link fence. The complicated three dimensional shape of these inserts increase their cost and do not allow compact shipping.

Plastic and paper cups are often inserted into a fence to form words. The cups lack design and color flexibility. The cups degrade in outdoor weather and are easily knocked out of the fence.

SUMMARY

In accordance with the present invention a tile type fencing insert comprises a rectangular sheet of flexible and resilient material with notches at the midpoint of each side. The rectangular sheet and notches are sized to allow placement within one cell of a chain link fence with portions of the sheet extending into adjoining cells.

Object and Advantages

An object of present invention is to allow great flexibility in the arrangement and color of inserts, where words, logos, advertisements, detailed decoration, or art may be formed in a chain link fence.

Another object of the present invention is to provide almost complete visual blockage in a chain link fence.

Yet another object is to provide inserts that are low cost and compact, allowing compact shipping and storage.

A further object of the present invention is to allow easy modification. Corners can be easily cutoff or shaped for greater design flexibility. Printed material may be adhered to the insert for additional visual effects.

A further object of the present invention is to provide accurate and rigid location of the insert.

The above objects of the invention can be accomplished by a rectangular sheet of flexible and resilient material (such as plastic) with notches at the midpoint of each side. The insert is temporarily bent by hand then inserted into a fence cell. Allowing the insert to straighten locates the notches around the wire crossover at each corner of the cell. The insert covers the cell and portions of the adjoining cells.

DRAWING FIGURES

Figure 3:
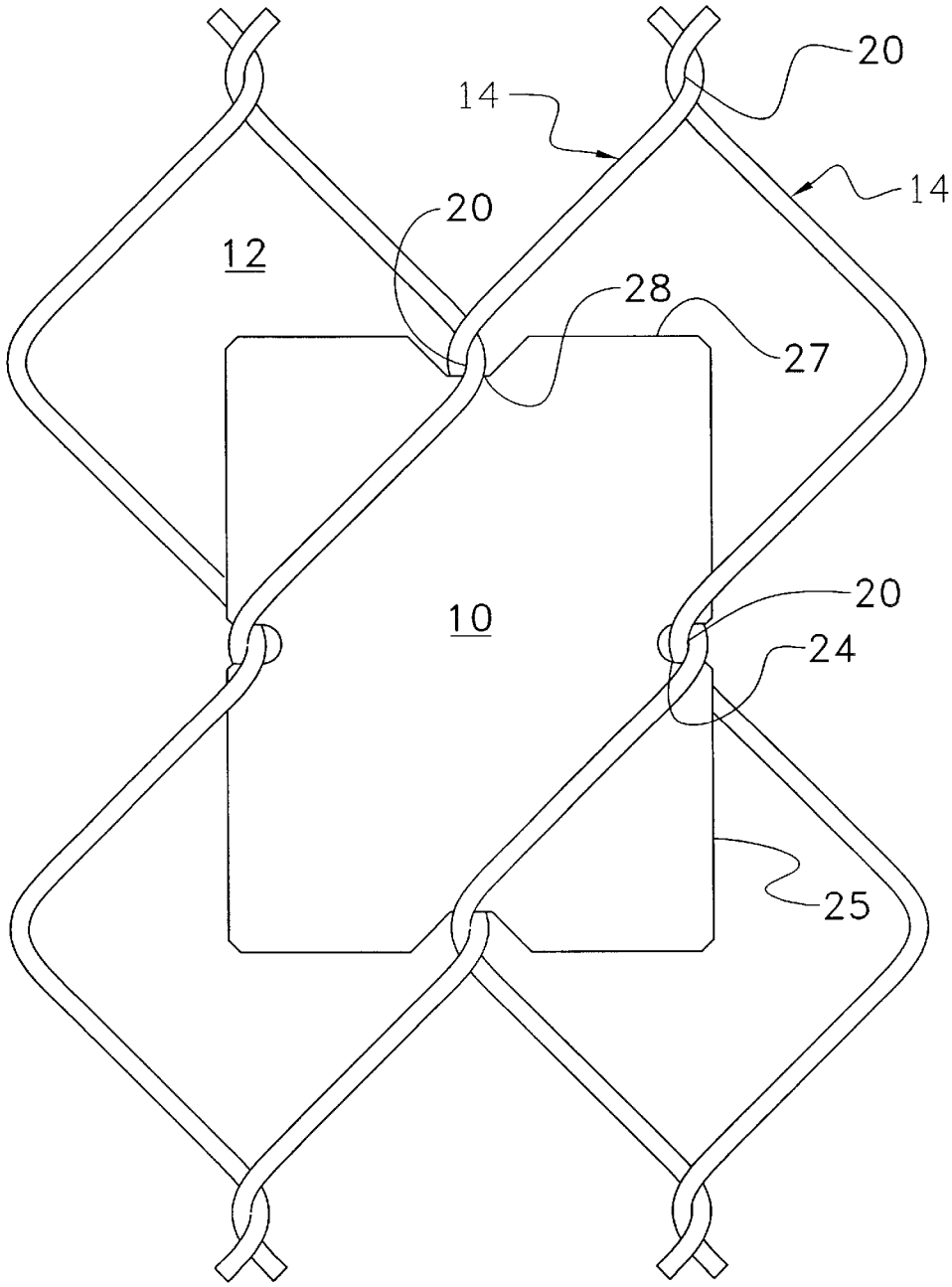
Figure 4:
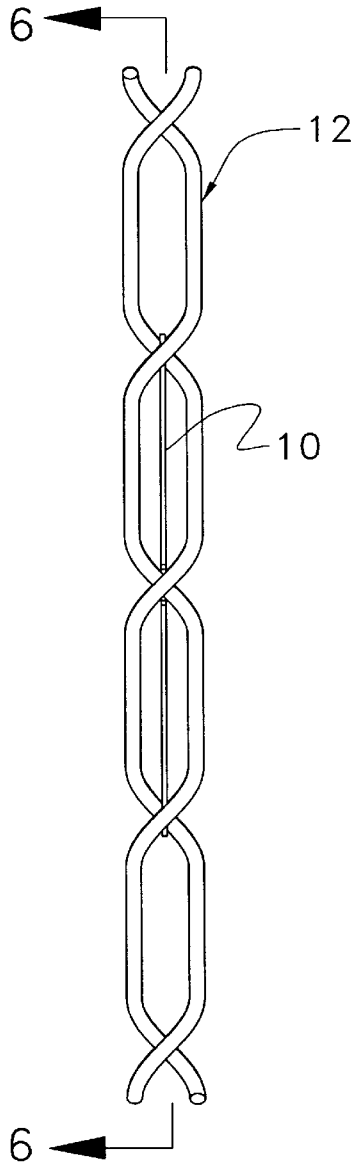
Figure 5:
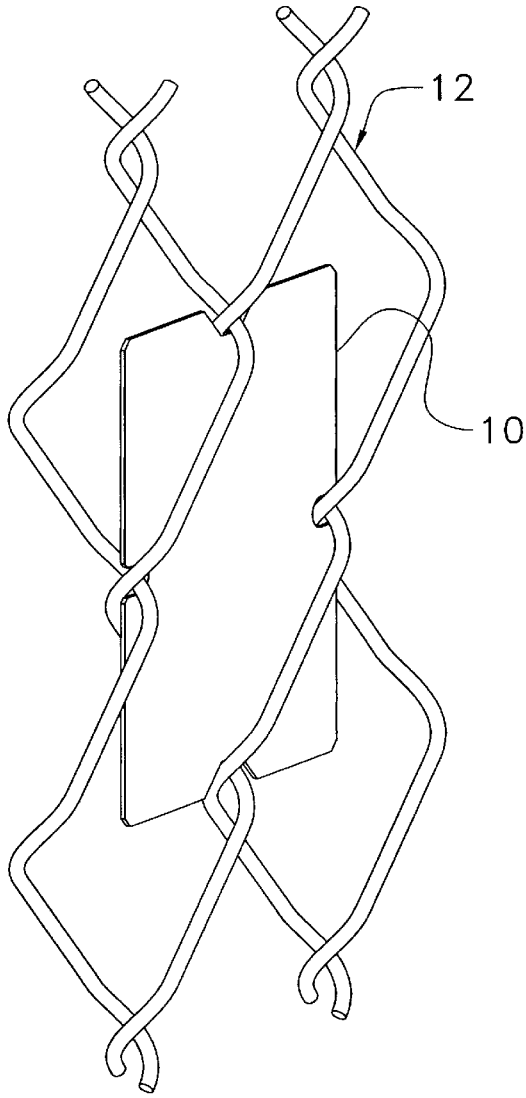
Figure 6:
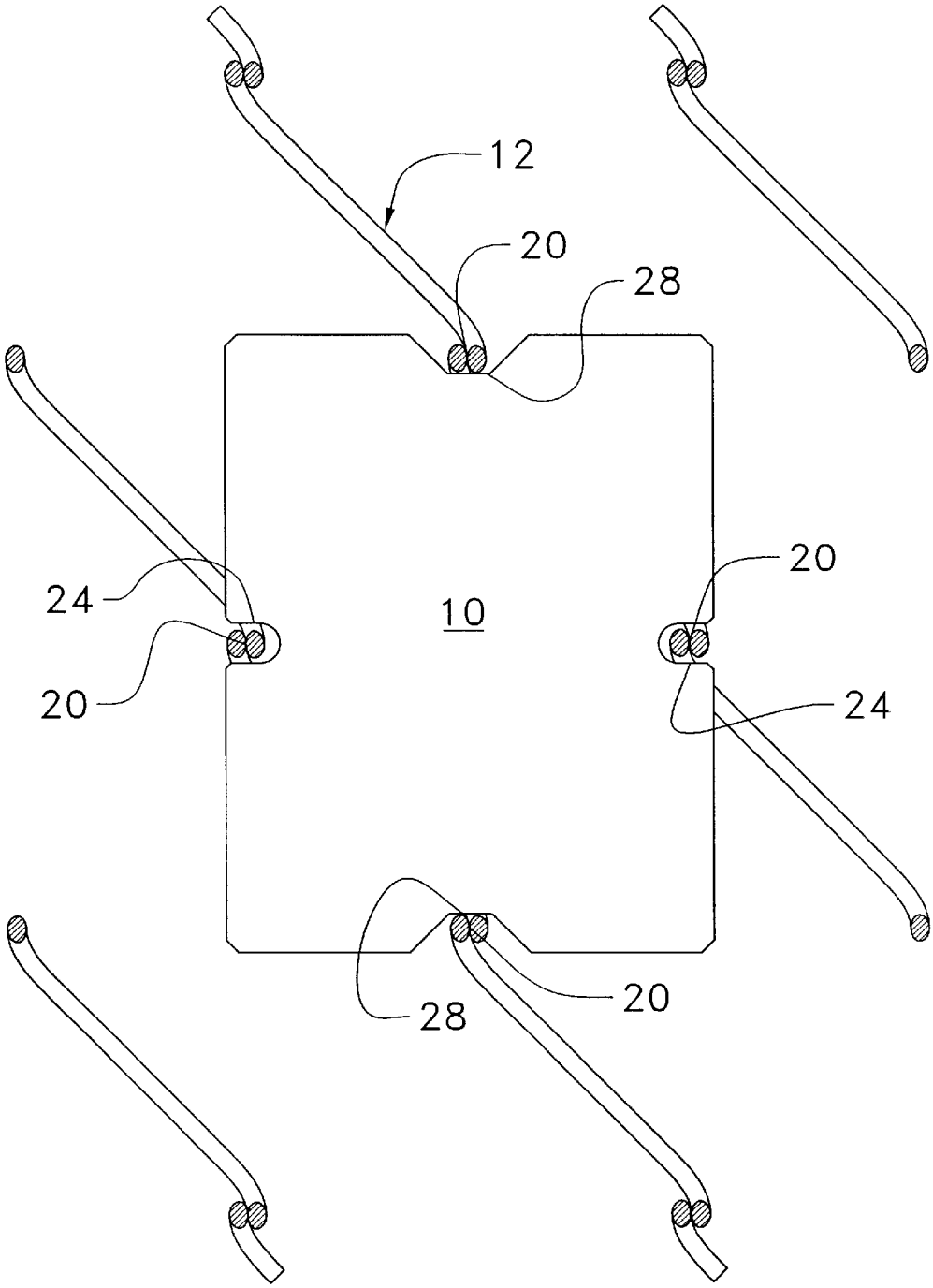
Figure 7:
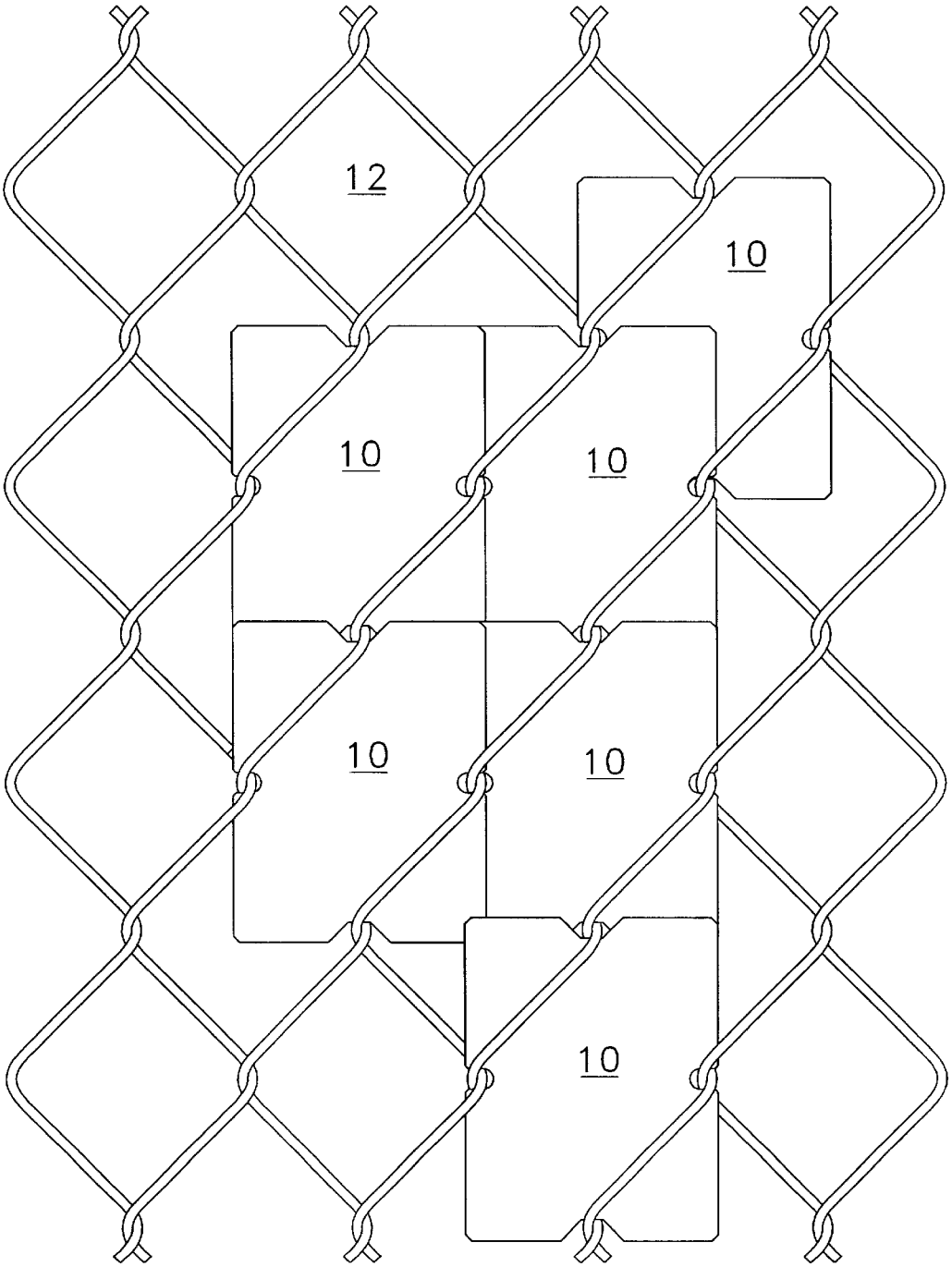
Figure 8A:
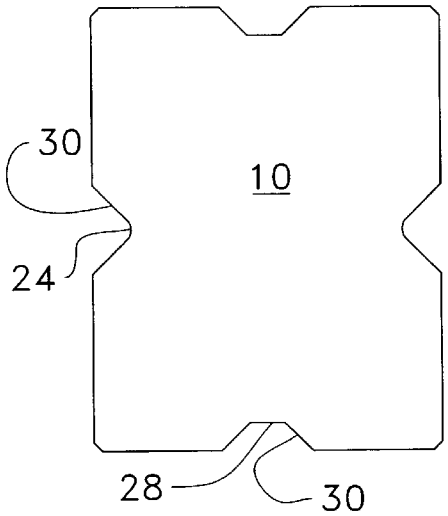
Figure 8B:
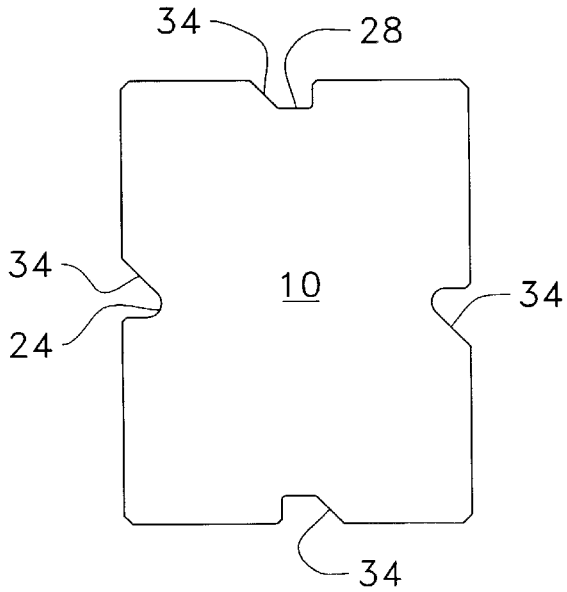
Figure 8C:
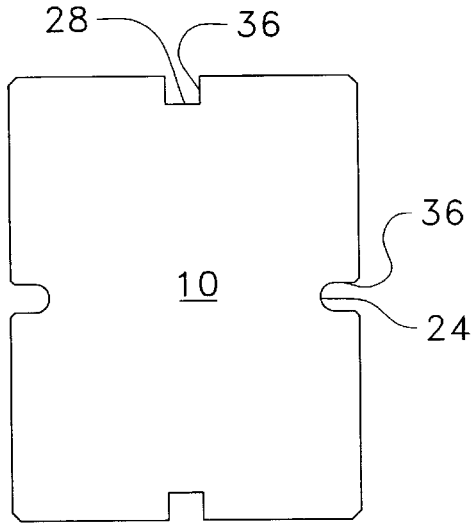
Figure 8D:
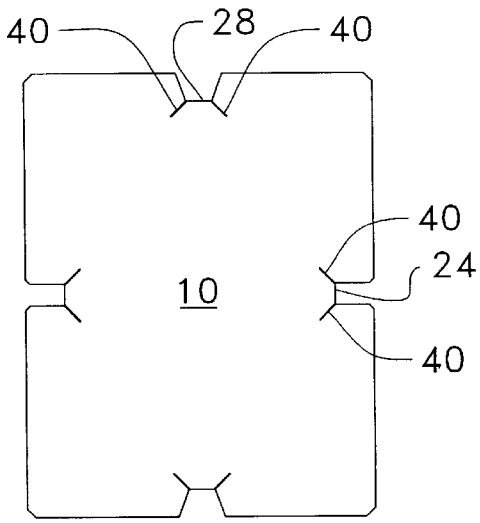
Figure 9A:
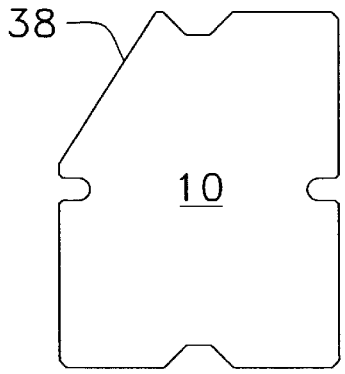
Figure 9B:
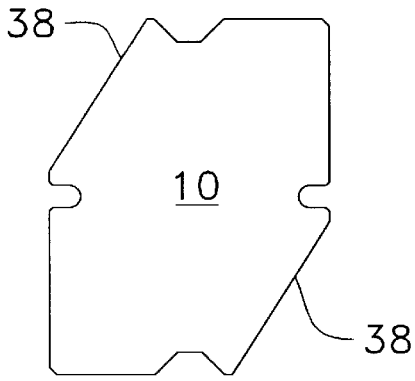
Figure 9C:
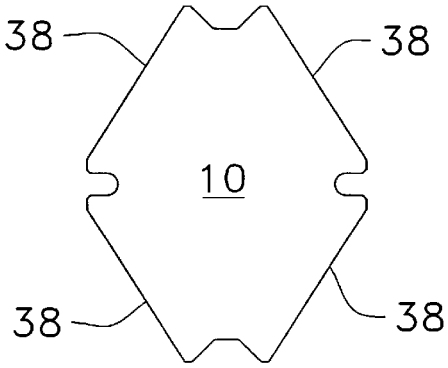
Figure 9D:
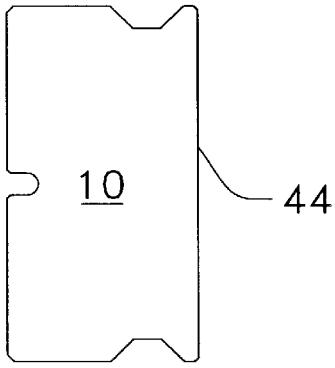
Figure 9E:
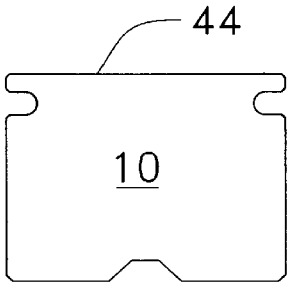
Figure 9F:
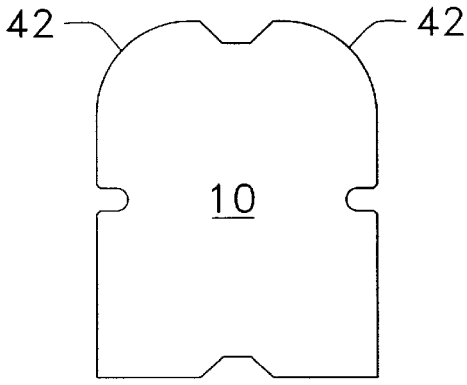
Figure 10:
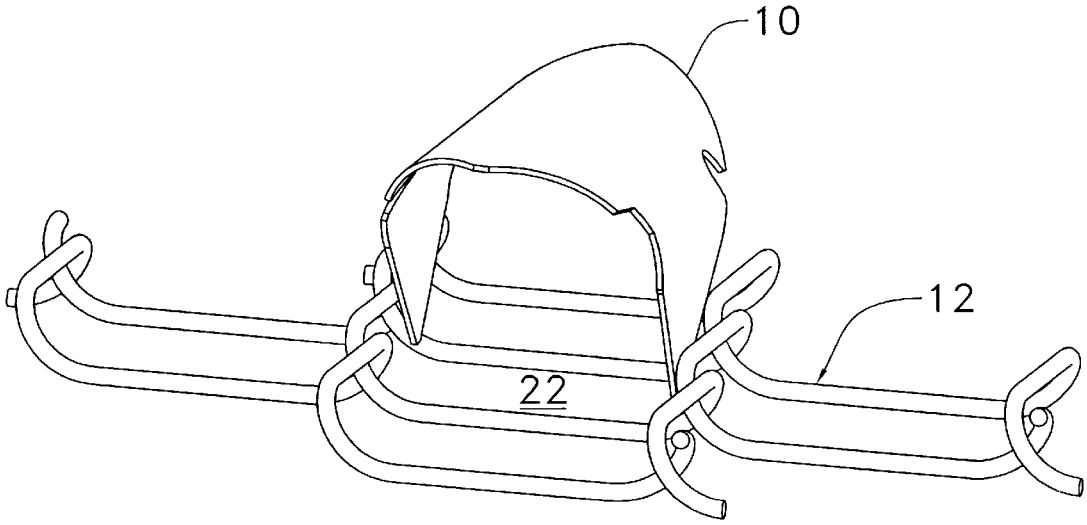
Figure 11A:
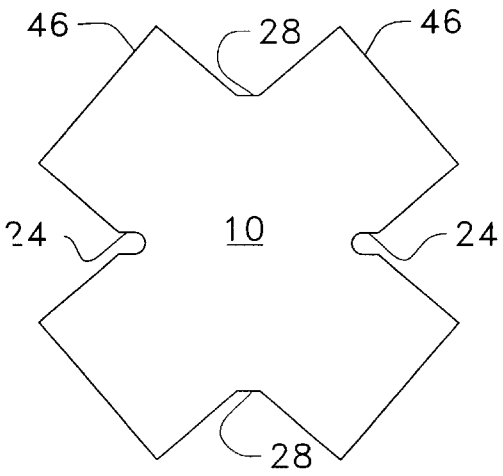
Figure 11B:
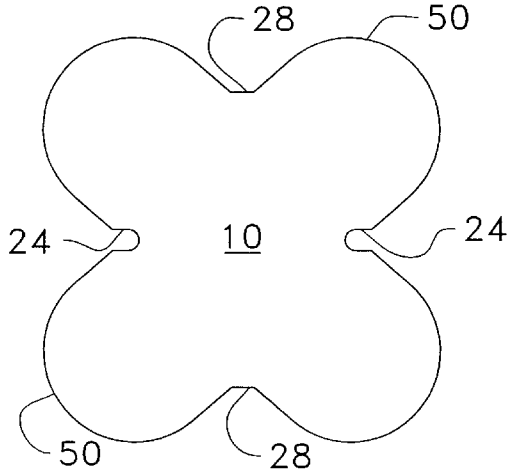
Figure 11C:
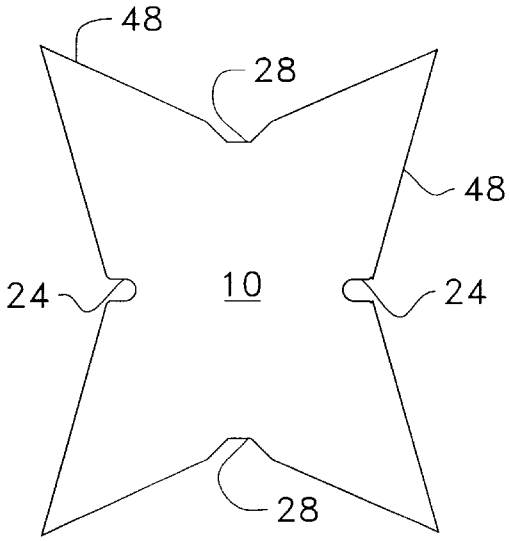
Figure 11D:
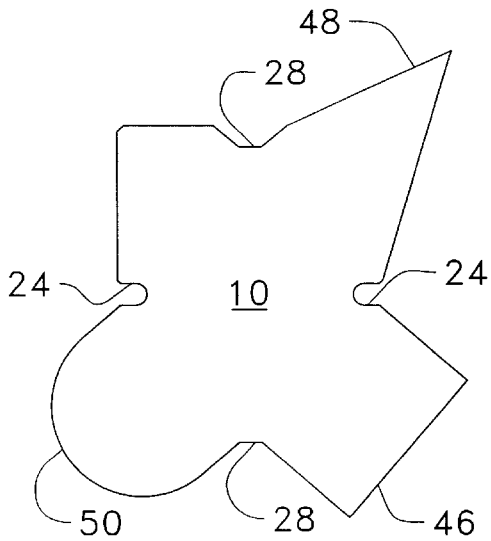
Figure 12:
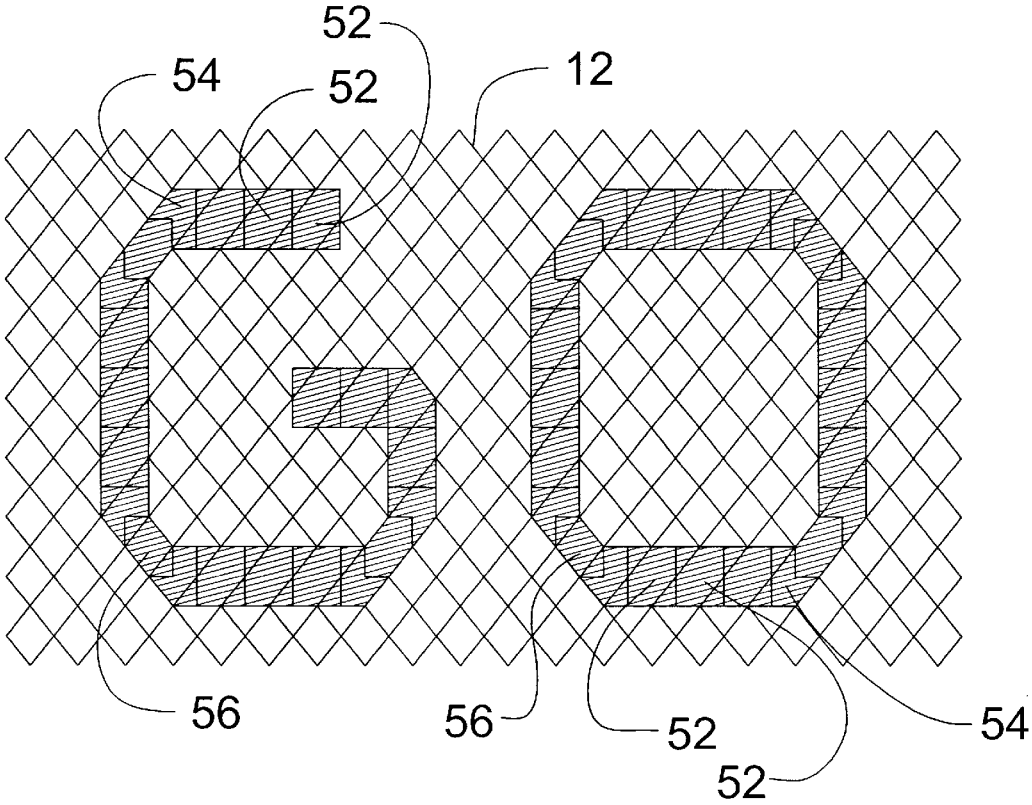

FIG. 3 is a front view of a portion of a prior art chain link fence with an insert installed FIG. 4 is a side view of a portion of chain link fence with one insert installed FIG. 5 is an isometric side view of a portion of chain link fence with one insert installed FIG. 6 is a cross section about through the mid-plane of a chain link fence with one insert installed showing how insert notches fit around wire crossovers FIG. 7 is a front view of a medium sized portion of chain link fence with several inserts installed FIG. 8A is a front view of an alternative embodiment showing angled side notches FIG. 8B is a front view of an alternative embodiment showing asymmetric notches FIG. 8C is a front view of an alternative embodiment showing straight sided notches FIG. 8D is a front view of an alternative embodiment showing slits extending away from notches FIGS. 9A through 9F are front views of alternative embodiments showing various edge modifications of inserts FIG. 10 is an isometric view of a temporarily bent insert being installed into a portion of a chain link fence FIGS. 11A through 11D are front views of alternative embodiments showing various corner modifications of inserts FIG. 12 shows inserts forming the word "GO" in a fence

REFERENCE NUMERALS IN DRAWINGS

10 rectangular sheet
12 chain link fence
14 formed wire
16 straight wire section
18 90 degree helix bend
20 wire crossover
22 cell
24 side notch
25 vertical edge
26 chamfer
27 top edge
28 end notch
29 bottom edge
30 angled sides
32 chamfered corner
34 asymmetric angled sides
36 straight sides
38 cutoff corner
40 slit
42 rounded corner
44 cutoff side
46 projected corner
48 stellated corner
50 projected rounded corner
52 rectangular insert
54 cut corner insert
56 two cut corner insert

DESCRIPTION

Figure 1:
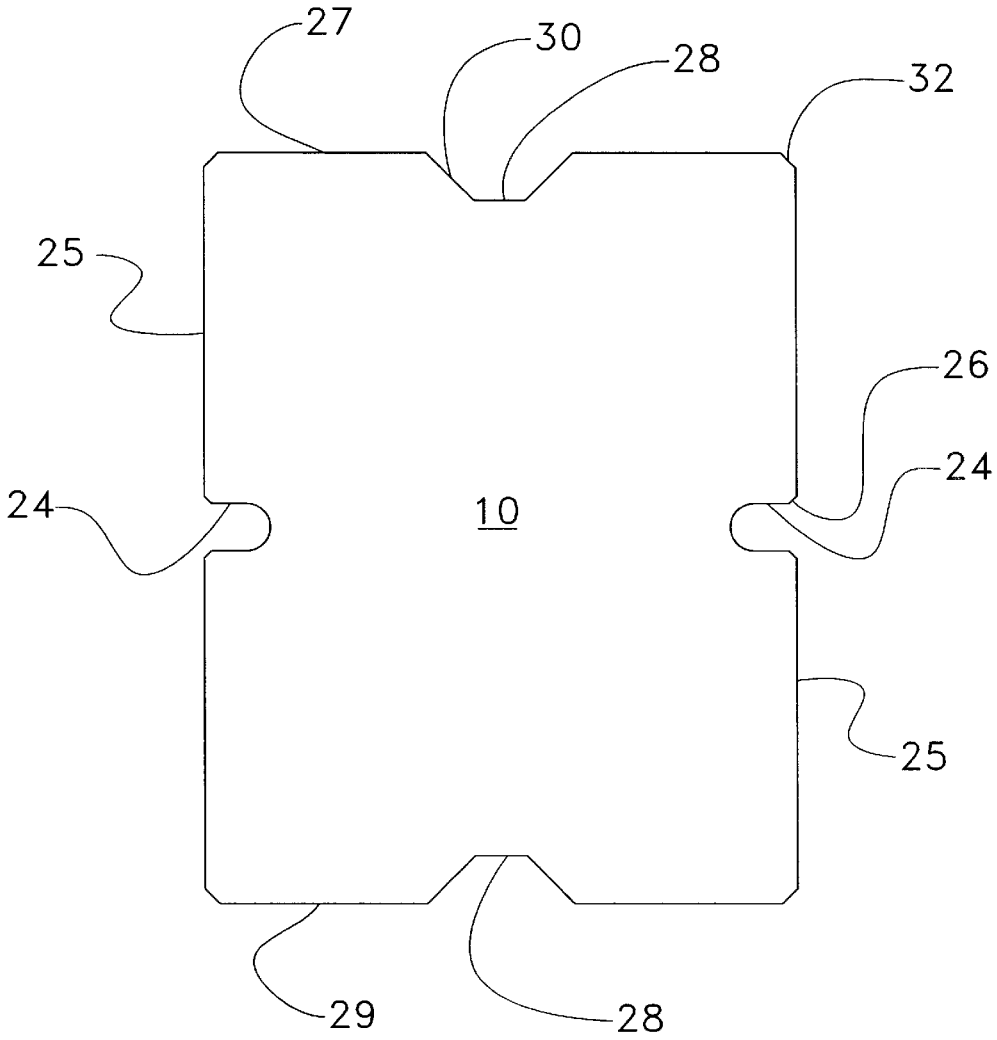
FIG. 1 is a front view of the preferred embodiment
Figure 2:
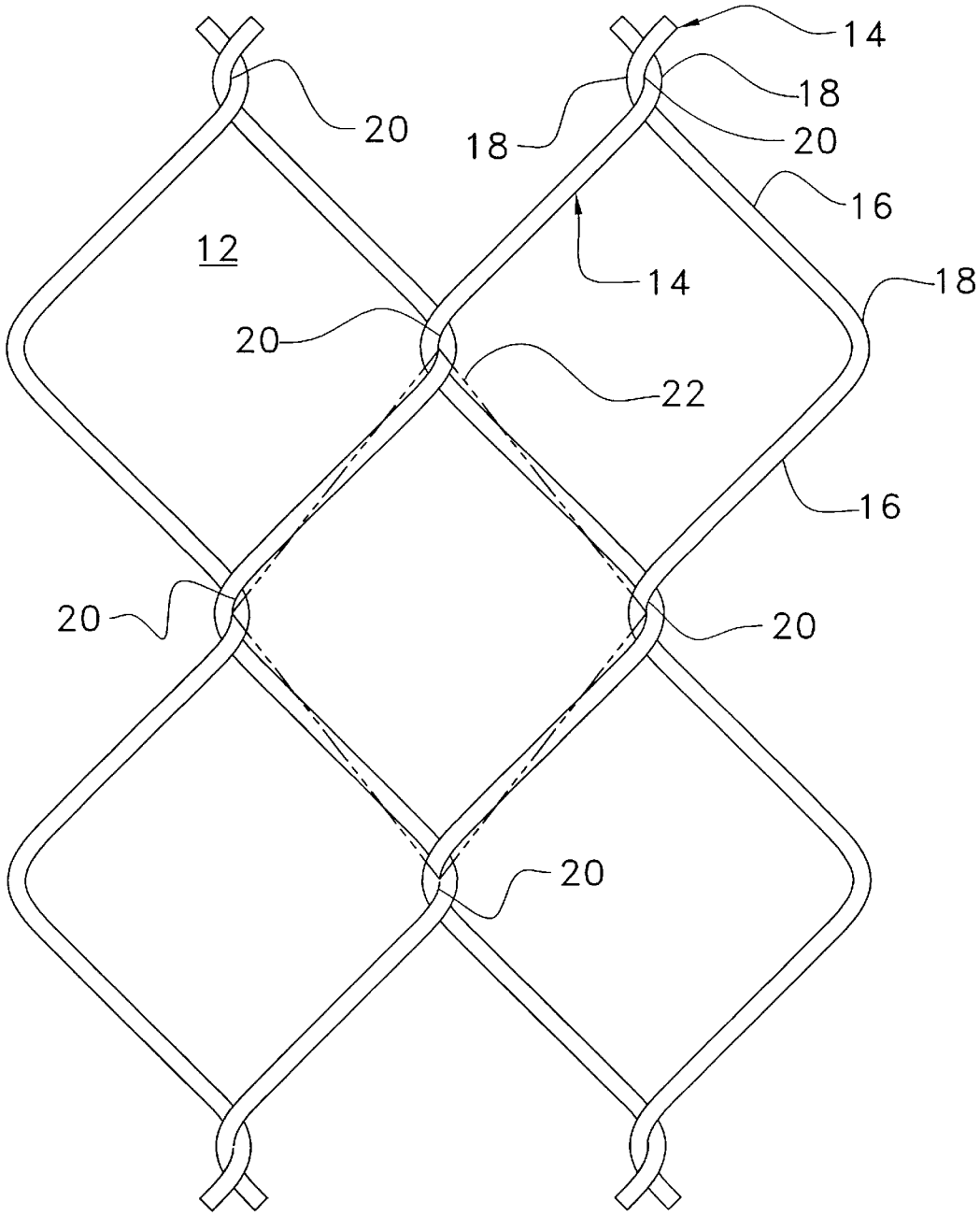
PRIOR ART FIG. 2
FIG. 2 is a front view of a portion of a prior art chain link fence

FIGS. 1 and 2 Preferred Embodiment

FIG. 1 is a front view of the insert. The insert is a rectangular shaped flat sheet 10. FIG. 2 shows the front view of a portion of a chain link fence 12. Chain link fence 12 is prior art and consists of formed wires 14. Each formed wire 14 is a repeating pattern of a straight wire section 16 then a 90 degree helix bend 18 then an another straight section 16 then another 90 degree helix bend 18 then the pattern repeats. Formed wire 14 looks approximately like a flattened helix. Formed wires 14 are woven together to form a chain link fence 12. Wires 14 cross at the middle of each 90 degree helix bend 18. These wire crossovers 20 define the corners of the diamond shaped cell pattern 22 of a chain link fence. The insert in FIG. 1 completely covers one cell and portions of adjoining cells. FIG. 3 shows a front view of an insert installed in a chain link fence 12. FIG. 4 shows the side view and FIG. 5 shows an isometric view.

FIG. 1 shows side notches 24 located at about the midpoint of the vertical edges 25 of the insert. Corners of the side notches 24 have chamfers 26 to allow easier installation. End notches 28 are located at about the midpoint of the top edge 27 and bottom edge 29 of the insert. Angled sides 30 of the end notches 28 allow easier installation. Chamfered corners 32 are provided to allow easier installation and reduce chances of poking or harming a finger or hand.

Insert width and height are the width and height of the cell 22 plus an additional amount. The additional amount is sufficient to allow side notches 24 and end notches 28 to extend around wire crossovers 20 located at the corners of the cell 22. Also the additional amount of insert width and height allow overlap with adjoining inserts. Overlap provides complete visual blockage and reduces finger pinching from adjoining inserts. Finger pinching may occur when a finger is forced between the juncture of two inserts.

FIG. 3 shows the insert in a portion of a fence. Side slots 24 and end slots 28 fit around fence wires 14 at their wire crossover 20 and locate and secure the insert in the chain link fence 12. FIG. 4 is a side view of the insert in a portion of a fence 12 showing the insert located at about the mid-plane of the fence 12. FIG. 6 is a cross section approximately through the mid-plane of a fence showing how side slots 24 and end slots 28 fit around wire crossovers 20.

Installation into the fence may be accomplished by bending two opposite corners of the insert together, placing the corners into a cell 22, as shown in FIG. 10, then allowing the insert to straighten. Sheet 10 material is flexible and resilient, such as plastic. Material yield strength, elastic modulus, and thickness are such to allow bending to install the insert without permanent deformation of the insert. Greater sheet 10 thickness requires lower elastic modulus and/or higher yield strength. Greater sheet 10 elastic modulus requires higher yield strength and/or less thickness.

FIG. 7 shows several inserts installed in a fence 12. Overlapping inserts are shown. Overlap is possible due to sheet 10 material being flexible and resilent.

FIGS. 8A thru 8D Additional Embodiments

FIGS. 8A thru 8D show several different notch treatments. FIG. 8A shows an insert with angled sides 30 on the side notches. This allows easier insertion into a fence. FIG. 8B shows an insert with asymmetric angled sides 34. This allows easier insertion into a fence while maintaining more contact with the wire crossovers than the insert shown in FIG. 8A. FIG. 8C shows an insert with notches that have straight sides 36. The insert will be more rigidly located however it will be more difficult to install. As can be seen by the variety of these examples notches may have a variety of shapes. They may also have curved sides, rounded ends, chamfered ends or any other configuration that allows the insert to fit around the wire cross over.

FIG. 8D shows notches with slits 40 extending away from the side notch 24 and end notch 28. This allows additional flexibility of the insert where it contacts the wire crossovers 20. Therefore the side of the notches can have more contact with the wire crossovers 20. Allowing a more controlled location of the insert, greater allowance for variation in fence and insert dimensions, and closing the small visual gaps that remain.

FIGS. 9A through 9F and 11A through 11D Alternative Embodiments

Inserts can also be non-rectangular. Inserts can have cutoff corners 38 such as shown in FIGS. 9A, 9B, and 9C. Inserts can have rounded corners 42 as shown in FIG. 9F. Inserts can have a cutoff side 44 as shown in FIGS. 9D and 9E. As long as three notches remain the insert can be secured in a fence. Corners can be extended. FIG. 11A shows an insert with projected corners 46. FIG. 11B shows an insert with stellated corners 48. FIG. 11C shows an insert with projected rounded corners 50. FIG. 11D shows an insert with a mix of corners including a preferred embodiment corner. Again, corners or edges can be modified by cutting, trimming, or even extending as long as at least three notches remain.

FIG. 12 shows inserts forming the word "GO" in a fence. Three shapes of inserts are used, a rectangular insert 52, a cut corner insert 54, and a two cut corner insert 56. The rectangular insert 52 has four straight edges such as shown in FIG. 1. The cut corner insert 54 has one corner cut off such as shown in FIG. 9A. The two cut corner insert 56 has two corner cut off such as shown in FIG. 9B.

ADVANTAGES

The tile like nature of this insert allows great flexibility in design of signage and decoration with simultaneous visual blockage using a chain link fence.

CONCLUSION, RAMIFICATIONS AND SCOPE

Accordingly, the reader will see that the fence insert of this invention can be used to cost effectively provide visual privacy, decoration, signage, or a combination of these effects using a chain link fence for the supporting structure. The flat shape allows compact shipping and easy manufacture, this allows cost effective supply of a variety of colors and configurations. The installation of the inserts at the mid-plane of the fence provides a robust and accurate locating method. The inserts are not easily dislodged by the wind, a thrown ball or rock, or a kick. Accurate location provides a uniform flat surface, which greatly assists decoration or signage. Also, an array of installed inserts can be further painted or decorated with laminations to provide more detail or variation in design. The ability to overlap and overlay inserts provides a method to decorate or sign over other inserts. So, the far side of a fence can display a completely different image than shown on the near side.

Although the description above contains many specificities, these should not be construed as limiting the scope of the invention but as merely providing illustrations of some of the presently preferred embodiments of this invention. For example an insert can have any polygon shape as long as three or four edges have notches that fit around the wire crossovers. The polygon edges can be extended to protrude or be rounded or curved as long as the edges do not interfere with other wire crossovers. As can be seen a wide variety of insert shapes are possible. Thus the scope of the inventions should be determined by the appended claims and their legal equivalents, rather than the examples given.

We claim:

1. An insert in combination with a chain link fence of a type comprising interwoven helixes of wire defining a plurality of uniform diamond-shaped cell openings each having four corners formed by crossovers of said wires, said insert further comprising;

a flat sheet of resilient material dimensioned to span at least three corners of a single one of said diamond-shaped cell openings and having at least three peripheral notches each positioned to engage a corresponding wire crossover at the three corners of said diamond-shaped cell opening;

whereby said notches are sized to fit around said wire crossovers at the corners of said cell opening and said resilient sheet allows bending to place said sheet into said cell opening with said notches around said wire crossovers and a return bias of said resilient sheet anchors said sheet in said cell opening at said crossovers.

2. The insert of claim 1 wherein said flat sheet of material has top and bottom edges with opposing notches formed therein, and said notches at the top and bottom edges have angled sides.

3. The insert of claim 1 wherein said opposing notches in the top and bottom edges of said flat sheet of material have asymmetric angled sides.

4. The insert of claim 1 wherein said flat sheet of material is substantially rectangular with at least one rounded corner.

5. The insert of claim 1 wherein said flat sheet of material is substantially rectangular with at least one cutoff corner.

6. The insert of claim 1 wherein said flat sheet of material is formed with at least one slit extending inwardly from one of said notches.

7. An insert in combination with a wire fence of a type comprising interwoven helixes of wire defining a plurality of uniform diamond-shaped cell openings each having four corners formed by crossovers of said wires, said insert further comprising;

a polygon shaped flat sheet having at least three edges and notches in each of the three edges of said sheet;

said edges and said notches being located such that said notches fit around three of the four wire crossovers at the corners of a single diamond-shaped cell opening when said sheet is generally flat;

and said resilient sheet is anchored in said cell opening and engaging said crossovers.

8. The insert of claim 7 wherein said polygon shaped flat sheet has at least four edges with notches in each of the four edges of said sheet of said sheet and said notches and said edges are arranged such that said notches fit around four of said wire crossovers at corners of said diamond-shaped cell opening when said sheet is generally flat.

9. The insert of claim 7 wherein said flat sheet of material has top and bottom edges with opposing notches formed therein, and said notches at the top and bottom edges have angled sides.

10. The insert of claim 7 wherein said notches have asymmetric angled sides.

11. The insert of claim 7 wherein said flat sheet of material comprises at least one rounded corner.

12. The insert of claim 7 wherein said flat sheet of material comprises at least one slit extending inwardly from one of said notches.

* * * * *